US005087031A

United States Patent [19]

Hoff

[11] Patent Number: 5,087,031

[45] Date of Patent: Feb. 11, 1992

[54] ARM EXERCISER

[76] Inventor: Ross W. Hoff, 448 N. Pleasant St., Norwalk, Ohio 44857

[21] Appl. No.: 681,921

[22] Filed: Apr. 8, 1991

[51] Int. Cl.[5] ..... A63B 23/00

[52] U.S. Cl. ..... 272/67; 272/117; 272/901; 272/DIG. 4

[58] Field of Search ..... 272/67, 68, 116, 117, 272/118, 130, 136, 138, 142, 143, 901, DIG. 4

[56] References Cited

U.S. PATENT DOCUMENTS

| | | | |
|---|---|---|---|
| 3,815,904 | 6/1974 | Weiss et al. | 272/901 X |
| 3,947,025 | 3/1976 | Hobbt, Jr. | 272/901 X |
| 3,953,026 | 4/1976 | Stokely | 272/901 X |
| 4,063,727 | 12/1977 | Hall | 272/67 X |
| 4,068,843 | 1/1978 | Frost | 272/118 |
| 4,157,179 | 6/1979 | Ecklor, Jr. | 272/67 |
| 4,811,944 | 3/1989 | Hoff | 272/67 |
| 4,902,009 | 2/1990 | Jodes | 272/118 X |
| 4,944,508 | 7/1990 | Collins | 272/DIG. 4 X |
| 4,957,281 | 9/1990 | Christolea, Jr. | 272/117 |
| 4,964,632 | 10/1990 | Rockwell | 272/118 |
| 4,982,955 | 1/1991 | Heasley | 272/118 |

*Primary Examiner*—Robert Bahr
*Attorney, Agent, or Firm*—Gustalo Nunez

[57] ABSTRACT

An arm exercising apparatus for developing and strengthening a person's wrist and arm muscules and other parts of the body such as biceps, quadriceps, deltoids, triceps, etc. The exercising apparatus is designed to closely duplicate the sport known as arm wrestling. The exercising apparatus includes a handle that is pivotally connected to a sleeve wherein said sleeve is slideably mounted over a shaft. Said connection allows a twisting action of the wrist which closely duplicates those movements and forces actually experienced in arm wrestling and further allows the handle to be adjusted at the proper height for the individual user. The above described sleeve and shaft assembly is further pivotally connected to a rotatable pulley shaft, wherein said pulley shaft is fixedly connected to a pulley which is designed to accept predetermined weights as selected by the user, the weights being the elements which provide the resistive force required by the user. The exercising apparatus can be adjusted to impose a rotational force on the handle at any given point of an arc described by the handle. In this manner, the user can practice with the user's arm being set at any of a plurality of positions. The arm exerciser may be attached to a table top or platform when in use.

2 Claims, 8 Drawing Sheets

ARM EXERCISER

BACKGROUND OF THE INVENTION

1. Field of the Invention

This invention is directed to an exercising apparatus for developing the muscles of the wrist, arm and chest, i.e. those muscles used primarily in the sport of arm wrestling.

2. Description of the Prior Art

The subject matter in this application is related to the subject matter found in U.S. Pat. No. 4,811,944 issued to the applicant. The instant application is an improvement over the "944" patent in its construction and in the manner of use which will soon be evident.

U.S. Pat. No. 4,811,944 issued to the applicant herein functions in a manner similar to the invention contemplated in this application. However, it will soon become evident that the construction of the instant invention is quite different.

The prior art is replete with various types of exercisers directed to developing arm, neck, chest and wrist muscles. It would appear that the majority of the exercisers utilize helical springs or elastic bands for providing the resistance required for the development of muscle. One such exerciser is U.S. Pat. No. 3,815,904 issued to Weiss, et al. which describes an exercising apparatus having two U-shaped hand grips which are connected to each other by a plurality of elastic closed bands, wherein the number of elastic bands determines the degree of resistance which is provided by the exercising device.

U.S. Pat. No. 3,947,025 to Hobby discloses yet another type of arm exercising device in which a helical spring provides the required resistance.

An example of an exercising device in which weights are used is shown in U.S. Pat. No. 4,068,843 issued to Frost. This exerciser is structurally complex and uses a table-mounted pivotally hinged arm which simulates an arm-wrestling opponent's arm.

SUMMARY OF THE INVENTION

The present invention is directed to an exercising apparatus of the type designed to exercise one's arm, and one which is portable, is ideal for home use and can also be used in gyms or the like. The instant invention uses weights to provide the required resistive force which the user needs to overcome. However, the instant invention lends itself quite well to use of a fluid such a compressed air in conjunction with a pneumatic cylinder by which the desired force can be applied to the arm exercising device. The exercising apparatus is excellent for developing upper abdominals, lower abdominals, quadriceps, anterior deltoid, triceps, biceps, etc. The sport of arm wrestling is coming into fashion in the U.S.A. and, hence, there is a need to provide those tools that the participants need in order to compete successfully. The instant arm exercising device fills that need.

Briefly, the exerciser is a pivotally mounted handle and arm assembly connected to a weight-bearing pulley assembly. The exerciser includes a handle which is pivotally connected to a first sleeve member, wherein said first sleeve member is telescopically mounted onto a first rod member. A slot provided on said first sleeve member permits some rotational movement to the first sleeve member with respect to the first rod member. This first rod member is also pivotally connected to a second rod member. Continuing, said second rod member being inserted into a bearing member and fixedly connected to a rotatable pulley member, said pulley member having a plurality of adjustable positions thereon and designed for receiving a weight loaded cable. The handle is adjustable to any desired height and can also be adjusted in a horizontal direction, which would increase or decrease the resistance felt by the user's wrist.

In use, the exercising apparatus is mounted to a stable surface and the pulley assembly is loaded with the desired amount of weights. The user grasps the handle and places his elbow on the stable surface at a point which lies generally along the longitudinal axis described by said bearing member. The user then moves the handle in a direction opposite the resistive force generated by the weights and in a plane generally parallel to the plane described by the pulley assembly. This arm exerciser closely duplicates arm wrestling as actually experienced by arm wrestlers. The exercising apparatus contemplated here is simple in construction, is not mechanically complex and is economical to fabricate. It is also portable which is convenient for a person who travels frequently and who wants to keep physically fit. The arm exerciser is also provided with an upwardly extending handgrip which the user grasps with the non-working hand, which gives the user additional body support when working out with heavy weights.

DESCRIPTION OF THE PREFERRED EMBODIMENT

Figure 1:
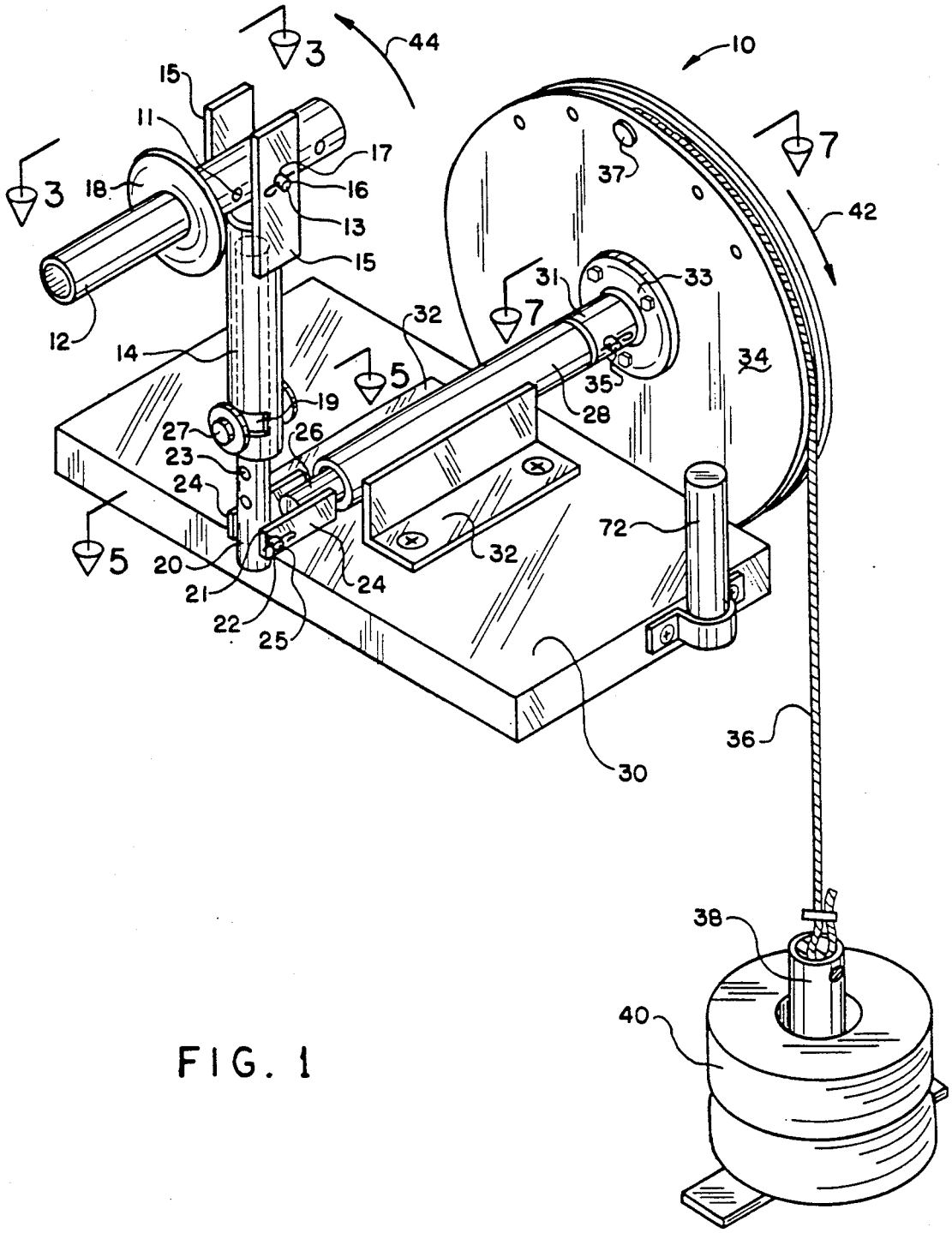
FIG. 1 is a perspective view of the exercising apparatus with the handle assembly in an upward position and the weights in a downward position.

The exercising apparatus to be further described in detail, as well as its objects and advantages over the prior art, may best be understood by reference to the following detailed disclosure and the drawings. It is understood, of course, that identical parts in the different figures are referred to by the same reference numeral.

Referring now to the drawings, the preferred embodiment is shown generally by the reference numeral 10. The exercising apparatus 10 includes a handle 12 which is pivotally connected to a first sleeve member 14 at pivot point 16. The connection at pivot point 16 may be made by any conventional means such as a pin or conventional bolt member. The handle is pivotally connected to the first sleeve member 14 by a pair of connecting members 15. Each said connecting member 15 having an aperture 17 thereon for receiving a pin 13. Said handle 12 is also provided with a plurality of apertures 11 also for receiving said pin member 13, thereby locking the handle 12 to the connecting members 15. Said connecting members 15 may be affixed to said first sleeve member by such conventional means as welding. The handle 12 also includes a handguard 18, the use of which shall be explained later. The handguard 18 may be a steel washer or a plastic spacer. Similarly, the handle 12 and other parts of the exercising device may be fabricated from any material having the tensile and compression strength necessary to overcome the fatigue which will be impressed on the exercising apparatus 10 by the forces which are imposed when the exercising apparatus 10 is in use. Other representative materials from which the exercising apparatus may be fabricated would be aluminum and steel alloys.

The first sleeve member 14 is provided with a slot 19 at one end thereof, said slot 19 being placed on said first sleeve member 14 such that said slot 19 describes a plane perpendicular to the longitudinal axis of said first sleeve member 14. Continuing, the first sleeve member 14 is telescopically mounted onto a first rod member 20, said rod member 20 being pivotally connected, by conventional means, at pivot point 22 to a connecting member, which in this instance comprises a pair of connecting members 24, each having an apperture 21 at one end thereof for receiving a pin connector 25. The connecting members 24 are affixed to a second rod member 26 by conventional and well-known means such as a weld connection. Still referring to FIGS. 1 and 2, it can be seen that the first rod member 20 is provided with a plurality of apertures 23 along the longitudinal axis thereof. The apertures 23 are used in cooperation with the slot 19 for receiving a connector 27 which pivotally locks the first sleeve member 14 to the first rod member 20. The first sleeve member 14 rotates about the first shaft member 20 along the entire length of the slot 19. Also the apertures 23 permit the vertical adjustment of the handle to accomodate the length of the user's arm.

The second rod member 26 is telescopically inserted into a bearing member 28; thus, the second rod member 26 is capable of rotational movement about a pivot point described by the longitudinal axis of said bearing member 28. The above described assembly is mounted to a stable surface such as a table or bench top by conventional means such as C-clamps, screws, bolts or U-bolts. In the embodiment shown, the exercising apparatus 10 is shown connected to a surface 30 by conventional angle members 32, which can be affixed to the bearing member 28, again by conventional means such as welding. Although the connecting members 15 and 24 are depicted as being a pair of parallel segments, they could easily be fabricated from cylindrical stock with a recess at one end thereof, said recess describing a U-shaped configuration.

Figure 7:
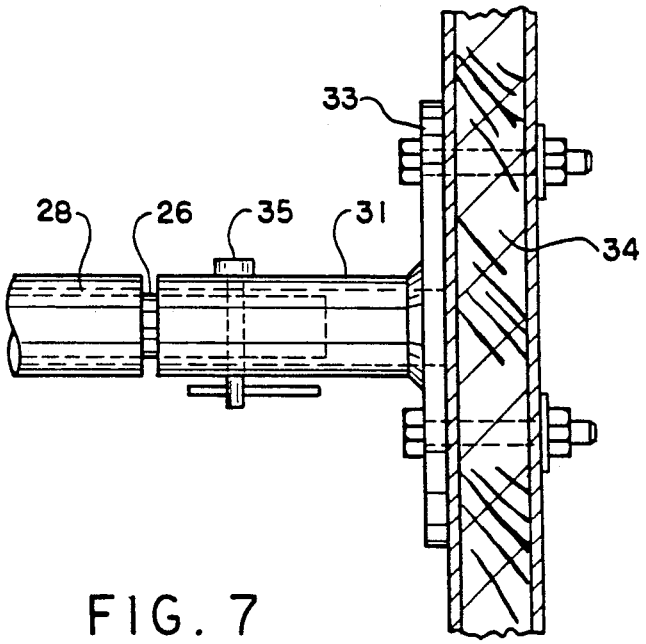
FIG. 7 is a cross-sectional view of the weight bearing pulley taken along lines 7—7 of FIG. 1.
Figure 8:
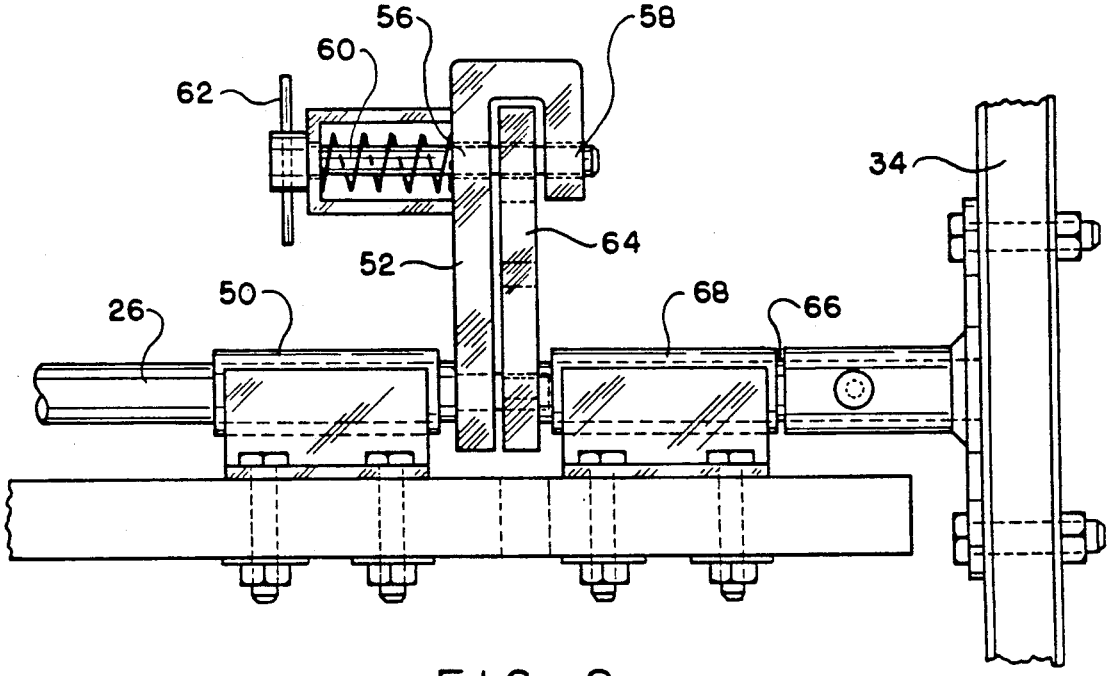
FIG. 8 is a plan view of a second embodiment of the weight bearing pulley illustrating an adjusting member assembly interposed between the handle assembly and pulley member.
Figure 8A:
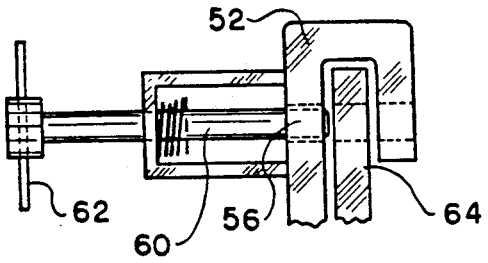
FIG. 8A is an enlarged view of the adjusting assembly illustrated in FIG. 8.
Figure 8B:
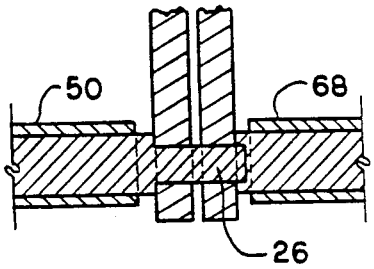
FIG. 8B is an enlarged cross-sectional view of the connection shown in the circle A of FIG. 8.
Figure 9:
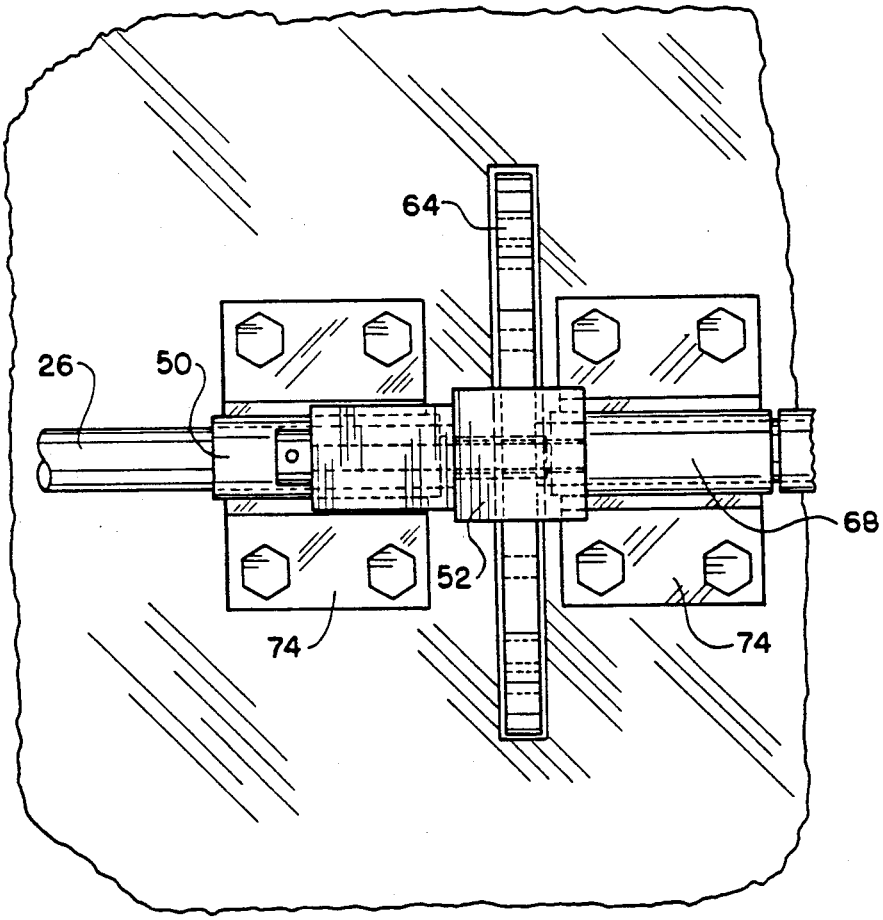
FIG. 9 is a partial top view of FIG. 8.
Figure 10:
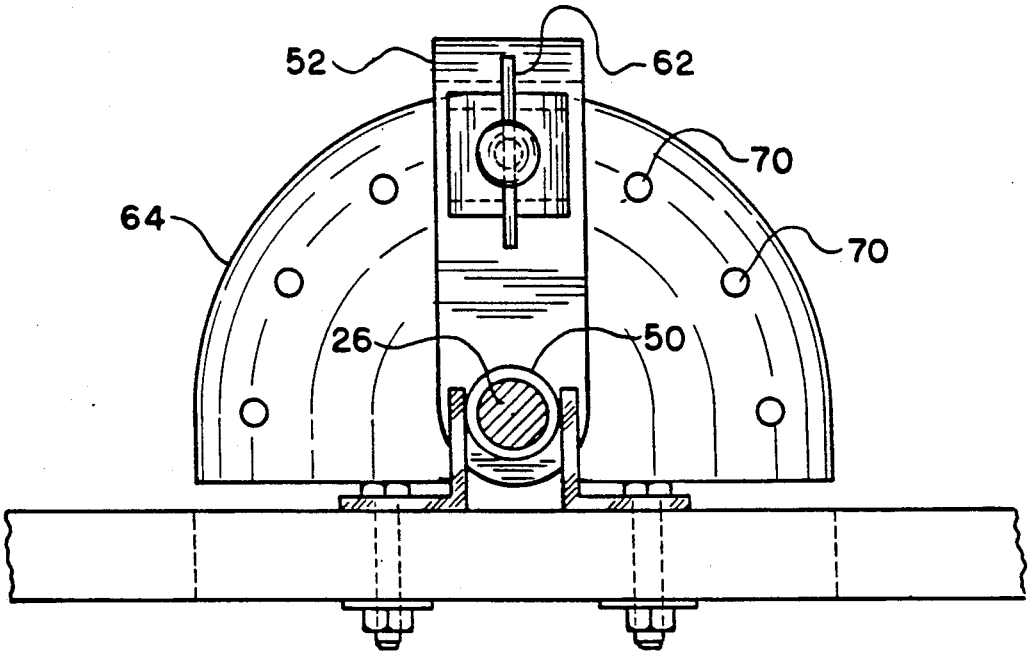
FIG. 10 is an elevation view of the adjusting assembly in a center position.

Referring to FIGS. 1 and 7, it can be seen that the second rod member 26 extends beyond one end of the bearing 28 and also extends beyond to the edge of surface 30. The terminating end of the second rod member 26 is connected to a pulley 34 by means comprising a connecting tube 31 which is affixed to a plate 33. Said plate 33 can be mounted on the pulley 34 by well-known means such as bolts. The second rod member 26 is inserted into the connecting tube 31 and held thereto by means of pin connector 35 which is inserted into an aperture located on both the second rod member 26 and connecting tube 31. A cable member 36, at one end, is attached to the pulley 34 by conventional means such as a pin 37, and at its other end is attached to a T-shaped member 38, said T-shaped member used for holding the desired weights 40. T-shaped member 38 may be permanently connected to the cable 36 or removably connected. The type of connection is determined by the types of weights which are to be loaded onto cable 36, e.g. in the event the connection is permanent, the weights used would include a slot for placing the weights onto the T-shaped member 38. In the event the connection is removable, the weights simply would be provided with an opening for insertion onto the T-shaped member 38.

The manner in which the exercising apparatus is utilitized can now be described. Referring again to FIG. 1, the user would grip the handle 10 by placing his hand up to the hand guard 18, which prevents the user's hand from sliding, and would place his elbow at a point generally lying on an axis described by the bearing member 28. The elbow must be placed at a distance from the exercising apparatus 10 such that the user can comfortably grip the handle 12 and impose a force on the handle sufficient to overcome the resistive force provided by the weight loaded pulley 34. Initially, the sleeve 14 and rod member 20 will be in a position perpendicular to the surface member 30. The weights 40 will impose a resistive force on the handle assembly 12 and sleeve 14 in a direction as shown by the arrow 42 adjacent the pulley 34. The user, while gripping the handle 12 will attempt to impose a rotational force in a direction opposing the force developed by the weight 40. At such time that the user applies a force to the handle 12, which exceeds the resistive force provided by the weight 40, said handle will move in a direction shown by the arrow 44. As can be seen from FIG. 2, the handle 12 can be rotated in a radial direction such that the handle 12 can be moved to a plane generally parallel to the surface 30. As a result of the telescopic connection between the sleeve 14 and the shaft 20, and the pivotal connection of the handle 12 at 16, the user experiences forces on his arm, wrist and hand that he would generally experience had he actually arm wrestled with another person. However, one exception exists such as when arm wrestling with an opponent, the forces each uses against the other will not be uniform, i.e. it depends on the physical stamina of the person such that an arm wrestler may attempt to overcome his opponent by exerting bursts of force. The exercising apparatus 10 as described exerts a uniform force throughout. This is the optimum condition for developing stamina and strength in the hand, wrist and arm.

However, because of the versatility and non-complexity of the exercising apparatus 10, it can be designed to function in a manner such that the user would experience uneven bursts of force such as one would experience in actual arm wrestling. One embodiment of such an exercising apparatus would be to connect the cable 36 to a conventional pneumatic cylinder. The pneumatic cylinder can be set at a predetermined force or the valve controlling the fluid, e.g. compressed air, can be programmed to change the force in a positive or negative direction by a certain percentage or percentages thus generating uneven bursts of forces which must be overcome by the user.

The exercising apparatus 10 may be used in various positions such as prone, standing or sitting positions, however, it is suggested that the sitting position is best. The telescopic connection of the sleeve 14 to the first rod member 20 permits the adjustment of the handle 12 to whatever height is required by the user simply by connecting the sleeve 14 to the desired aperture 23. The exercising apparatus 10 may be used by left-handed persons or right-handed persons, the only adjustment required being to reverse the direction of the cable 36 on the pulley 34. In the event that it is necessary to adjust the length of cable 36, the pulley 34 is provided with a plurality of apertures which are used to connect the cable to different positions of the pulley.

It can also be seen that the handle 12 may be shortened simply by removing the pin 13 and moving the handle 12 towards the pulley wheel and reconnecting the handle 12. Moving the handle 12 inwardly results in decreased resistance to the wrist and arm of the user. A rotational movement is allowed to be applied to the first sleeve member 14 by reason of the slot 19. This rotational movement simulates the rotational movement experienced by an arm wrestler in actual competition. This is important because in actual competition, the arm wrestler's wrist is continually rotating back and forth.

A second embodiment of the invention would incorporate the pulley connection assembly shown in FIGS. 8, 9, 10 and 11. The pulley connection assembly allows the user to start his arm wrestling training at any position.

In the second embodiment, the second rod member 26 is now inserted into a bearing member 50 and on through said bearing member 50 through adjusting lever 52, which is U-shaped at one end thereof when viewing it from the side, and on through adjusting wheel 64. Apertures 56 and 58 are provided at the U-shaped end of lever 52 and are designed to receive a spring loaded pin 60 including a release handle 62 such that when the release handle 62 is moved in a direction away from said adjusting member 52, a space is formed inside the U shape configuration of adjusting lever 52. The rod member 26 extends out beyond the adjusting member 52 and on through the bottom portion of an adjusting wheel 64. The terminating end of rod member 26 is received in a recess formed on one end of a third rod member 66 which is rotatably inserted into a bushing 68. Rod member 66 is then connected to the pulley 34 as described previously. Second rod member 26 is rotatable with respect to adjusting lever 52 and adjusting wheel 64. The upper portion of the adjusting wheel 64 fits within the space formed by the U-shaped terminating end of the adjusting lever 52. The adjusting wheel 64 is provided with a plurality of apertures 70 each of which can be placed in alignment with the apertures 56 and 58 thereby allowing the pin 60 to lock the adjusting wheel 64 to the adjusting lever 52.

The just described second embodiment permits the user to practice from a pinned down position and/or through a range extending to an upright or unpinned position, which would represent the starting position in an actual contest.

The operation of this embodiment will now be described. Assuming that a right-handed arm wrestler wants to start from a pinned down position, looking at FIG. 10, the user would release the biased pin 60 and rotate the handle 12 clockwise to a position close to the plane described by the surface 30. The biased pin 60 would then be inserted into the aperture identified as 70, and thus locked in place. In this position, the user, upon applying his hand onto the handle 12, will immediately feel the entire force provided by the weight 40.

Figure 2:
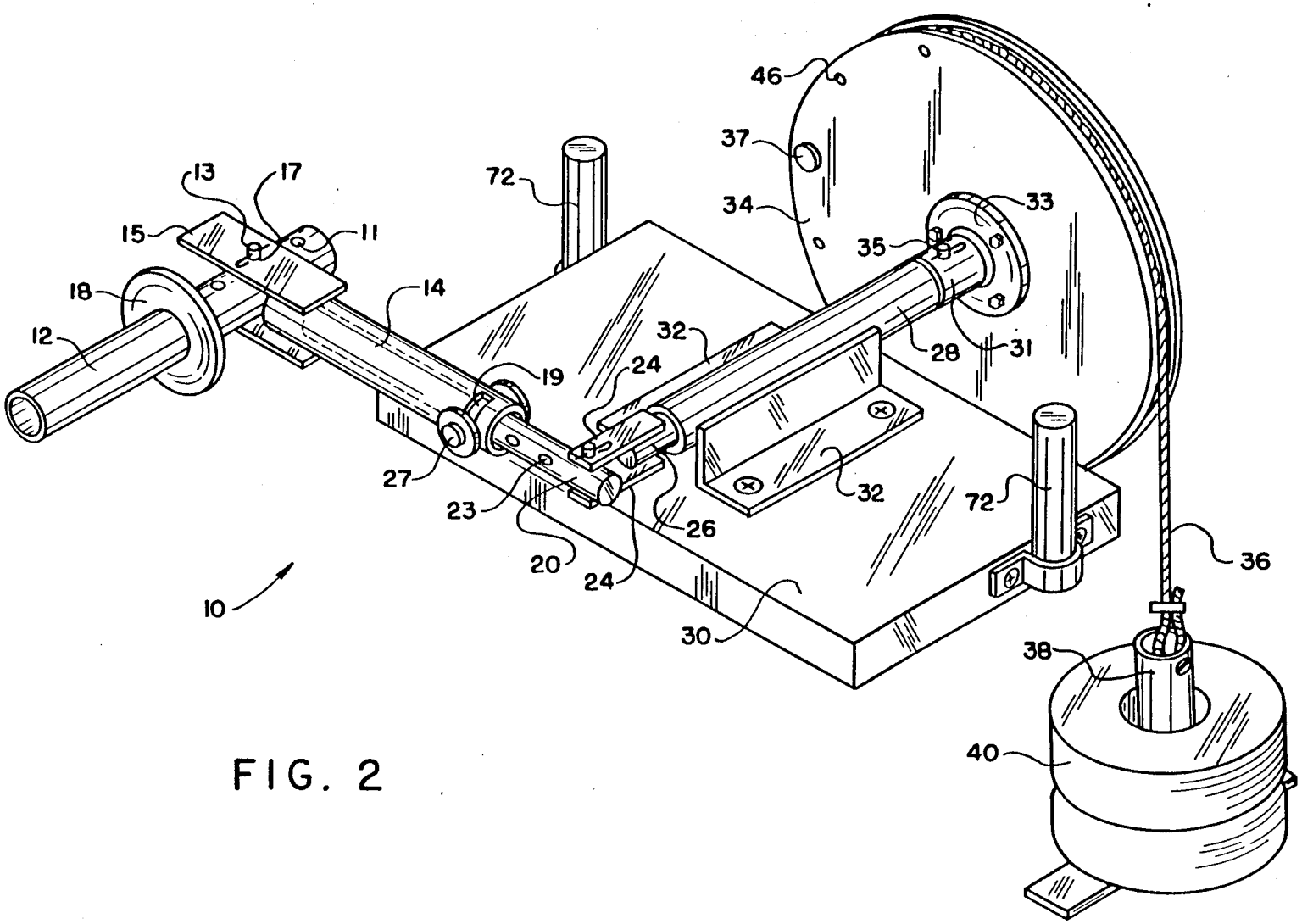
FIG. 2 is a perspective view of the exercising apparatus with the handle assembly in a downward position and the weights in an upward position.
Figure 3A:
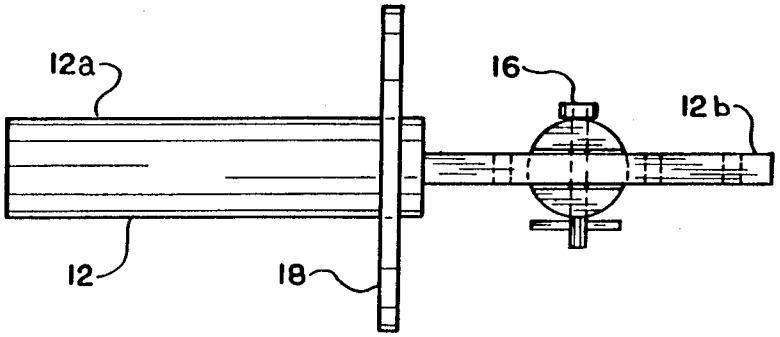
FIG. 3A is a second embodiment of the handle assembly shown in FIG. 3 in which the forward portion of the handle member is flat in construction.
Figure 4A:
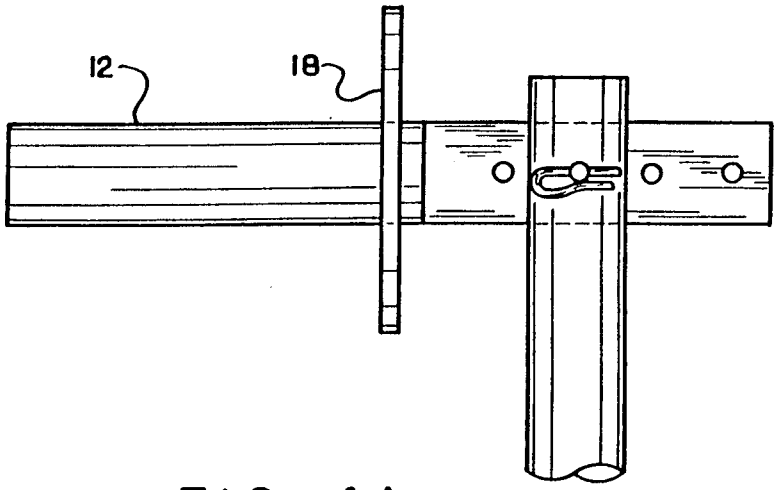
FIG. 4A is a side view of the handle assembly taken along lines 4A—4A of FIG. 3A.
Figure 3:
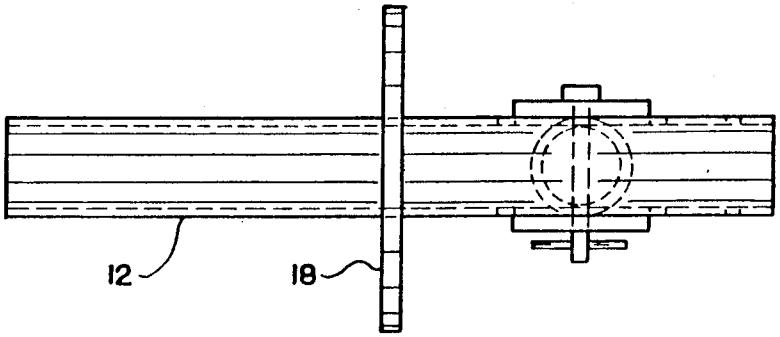
FIG. 3 is a top plan view of the handle assembly taken along lines 3—3 of FIG. 1.
Figure 4:
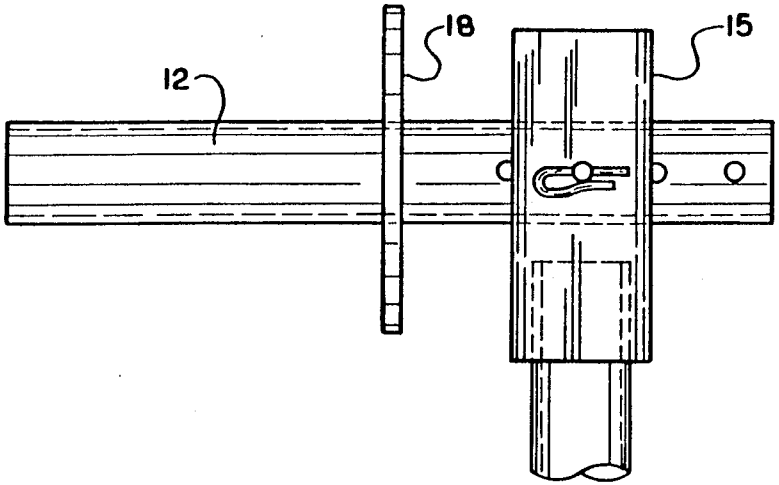
FIG. 4 is a side view of the handle assembly taken along lines 4—4 of FIG. 3.
Figure 11:
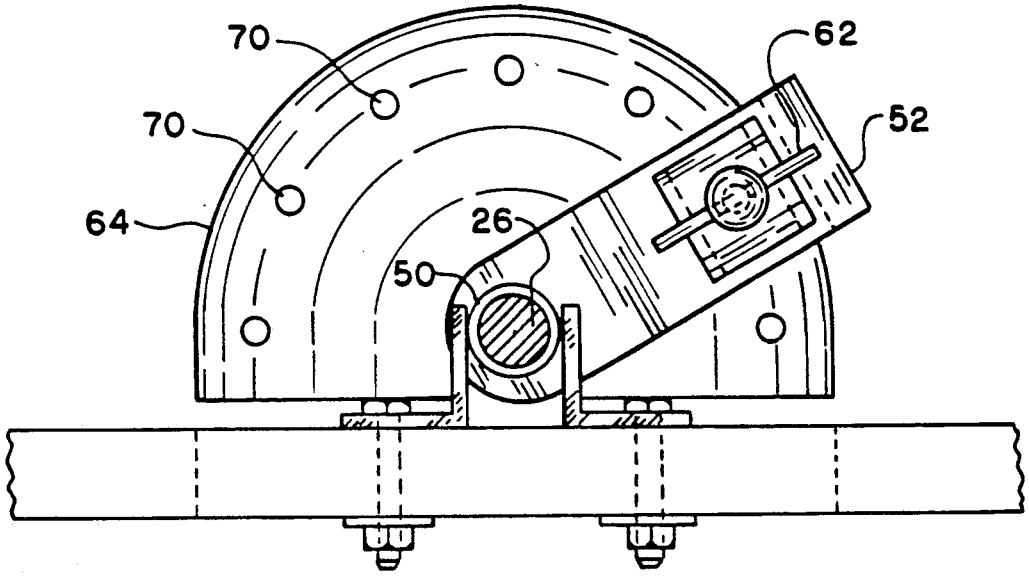
FIG. 11 is an elevation view of the adjusting assembly in an off center position.

Thus it can be seen that the embodiment illustrated in FIGS. 1 and 2 is used to train a wrestler from a starting position where the user's arm is in an upright position. The embodiment describing the pulley assembly illustrated in FIGS. 8, 9, 10 and 11 would allow a user to train from any position. FIG. 11 illustrates the arm exercising apparatus being used in a manner such that the starting position is somewhere between a fully pinned down position and a fully upright position. FIG. 3 is an enlarged view of the handle 12 connection shown in FIGS. 1 and 2. FIG. 3A illustrates yet another type of connection which can be made between the handle 12 and the first rod member 14. The handle 12 is illustrated as having first and second ends where the first end **12*a* is of a dimension greater than the second end 12*b*. A sleeve 14 is provided with a slotted terminating end for receiving the second end 12*b*, which is then connected to the sleeve member 14 by means of a connecting pin 16. This type of connection removes the need of having connecting members 15**, thus simplifying the construction.

Figure 6A:
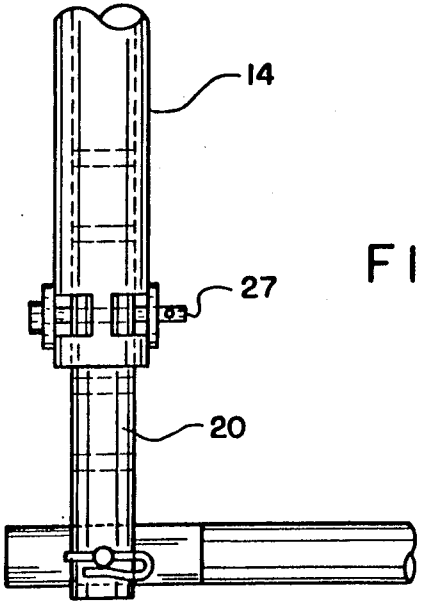
FIG. 6A is a side view of a second embodiment of the handle member and rod member connection.
Figure 6B:
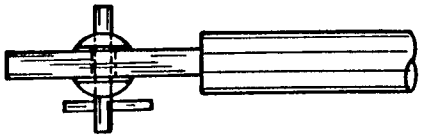
FIG. 6B is a plan view of a second embodiment of the handle assembly and rod member connection taken along 6B—6B of FIG. 6A.
Figure 5:
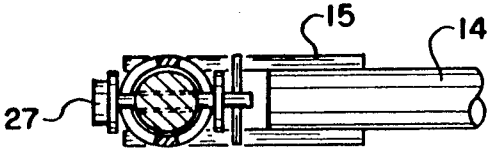
FIG. 5 is a sectional view taken along lines 5—5 of FIG. 1 illustrating the connection of the handle assembly to the second rod member.
Figure 6:
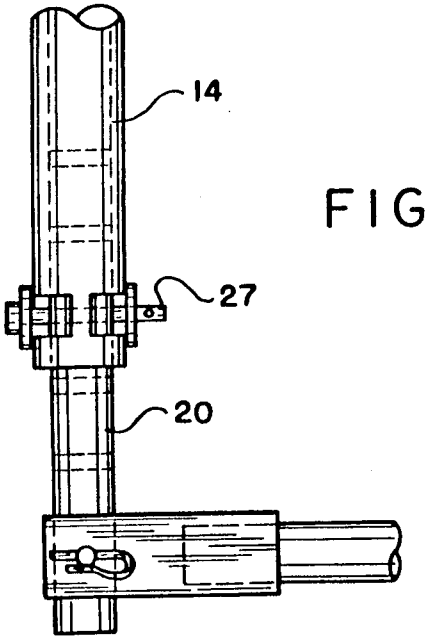
FIG. 6 is a side view of the handle assembly and second rod member connection shown in FIG. 5.

FIGS. 5 and 6 illustrate the type of connection used in between the first rod member 20 to the connecting members 24. FIGS. 6A and 6B illustrate yet another type of connection. A slot 28 is cut on one end of the second rod member 26. The first shaft member 20 is of a dimension which can be received by the slot and locked in place by means of a connection pin 25.

FIGS. 1 and 2 show a stabilizing handle 72 affixed to the surface 30. The stabilizing handle 72 is grasped by the user's free hand thus affording the user more stability, which is important when using large weights.

Figure 12:
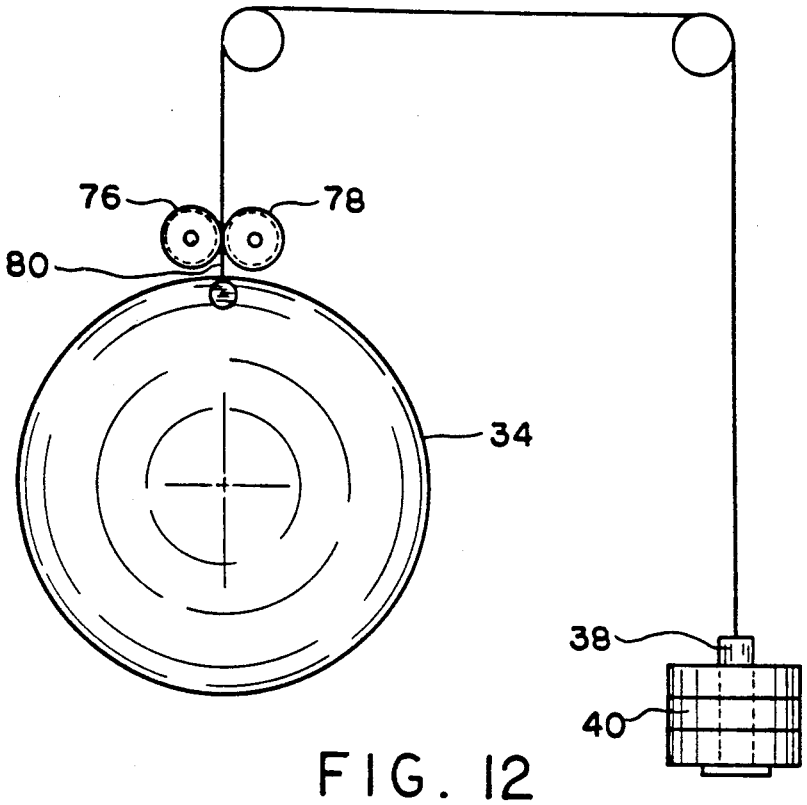
FIG. 12 is a schematic diagram of the weight bearing pulley in combination with a pair of guide pulleys.
Figure 13:
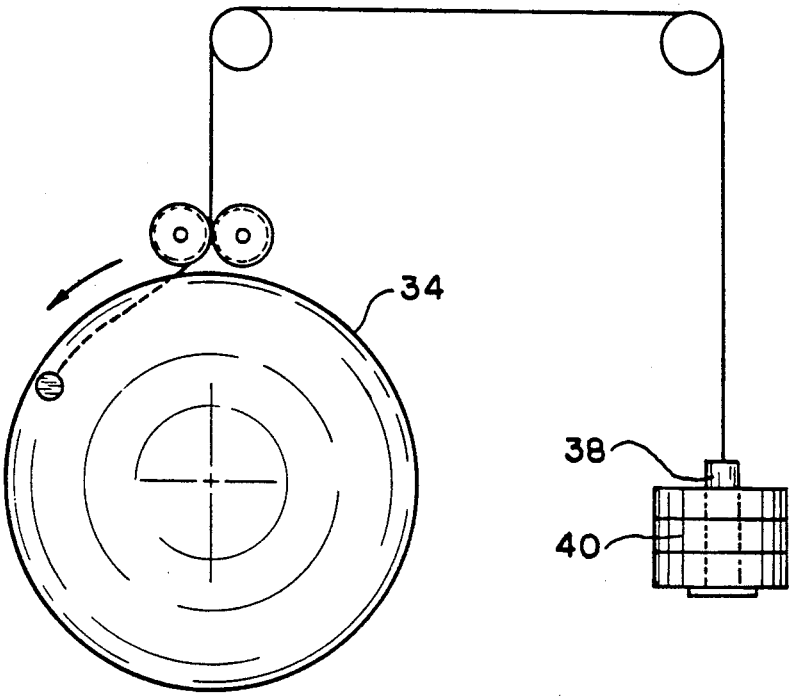
FIG. 13 is a schematic diagram of the weight bearing pulley in combination with a pair of guide pulleys and illustrating the pulley in rotation.

The embodiment shown in FIGS. 12 and 13 illustrates pulleys 76 and 78 immediately adjacent to pulley 34. Pulleys 76 and 78 insure that regardless of the degrees of rotation that pulley 34 experiences, the resistive force will remain a constant. It can be seen that the length of the cable from the pulleys 76 and 78 to pulley 34 will always be substantially the same regardless of what point the pulley 34 is rotated.

It is understood that the form of the invention herewith shown and described is to be taken as a preferred example of the same and that it will be apparent to those of ordinary skill in the art, upon reading this disclosure, that other modifications and variations can be made. Accordingly, reference should be made to the appended claims for determining the full and complete scope of the present invention.

I claim:

1. An arm exercising apparatus comprising:

an elongated handle member including a hand guard and a plurality of apertures along the longitudinal axis thereof at one end thereof;

a first elongated sleeve member including an opening throughout its longitudinal axis, said first elongated sleeve member terminating at one end with connecting means, said connecting means including a pair of apertures in opposite relationship and in axial alignment with respect to each other, said first elongated sleeve member further including at the end opposite said connecting means an elongated slot, said slot being perpendicular to the longitudinal axis of said first sleeve member;

means for pivotally connecting said handle to said first sleeve member at a point defined by the alignment of apertures of said handle member and said apertures located on said connecting means;

a first rod member telescopically inserted into said first elongated sleeve member, said first rod member including a plurality of apertures therethrough along the longitudinal axis thereof;

said first sleeve member rotatably connected to said first rod member by means of a locking pin through said apertures located on said first rod member and through said elongated slot located on said first sleeve member;

a a second elongated rod member terminating at one end thereof in a U-shaped configuration, said U-shaped terminating end including a pair of apertures oppositely disposed and in axial alignment with respect to each other;

means for pivotally connecting said second elongated rod member to said first rod member at a point such that the apertures located on said first rod member are in alignment with apertures located on said U-shaped configuration;

an elongated bearing member adapted to rotatably receive said second elongated rod member;

a pulley member;

means for connecting said pulley member to said elongated rod member; and, means for attaching a load to said pulley member.

2. An arm exercising apparatus comprising:

an elongated handle member including a hand guard and having a plurality of apertures along the longitudinal axis thereof at one end thereof;

an elongated first sleeve member terminating at one end thereof with a pair of oppositely disposed apertures in alignment with respect to each other;

said elongated first sleeve member further including at the other end thereof an elongated slot wherein a plane described by the slot being generally perpendicular to said longitudinal axis of said first sleeve member;

means for pivotally connecting said handle member to said first sleeve member, a pivot point being defined by the alignment of said apertures on said handle member and the apertures on said first sleeve member, said connecting means being inserted therethrough;

a first rod member telescopically received by said elongated first sleeve member and including a plurality of apertures at one end thereof, said aperture defining a plane generally lying along the longitudinal axis of said first rod member;

said first sleeve member rotatably connected to said first rod member by means of a locking pin through said apertures located on said first rod and through said elongated slot located on said first sleeve member, a second elongated rod member having at one end thereof a pair of apertures;

a generally elongated bearing for rotatably receiving said second rod member;

means for pivotally connecting said first rod member to said second elongated rod member, said apertures located on said first rod member and on said second elongated sleeve member, defining a pivot point for the connection between said first rod member and said second elongated sleeve member;

an adjusting lever having a U-shaped termination at one end thereof and having an aperture at the other end thereof, said aperture being adapted to rotatably receive said second elongated rod member, said adjusting lever further including at the U-shaped end thereof an aperture receiving a spring loaded locking key;

an adjusting wheel having the configuration of a semicircle, said adjusting wheel including a plurality of apertures along the periphery thereof and an aperture located generally at the center thereof and said aperture adapted to rotatably receive said second elongated rod member, said adjusting wheel being fixedly connected to said adjusting lever by means of said spring loaded locking key passing through a selected aperture located on said adjusting wheel;

a third rod member fixedly connected to said adjusting wheel, generally at the center thereof, said third rod member including a recess at the connecting end for rotatably receiving said second rod member;

a pulley member;

means for connecting said third rod member to said pulley member and means for attaching a load to said pulley member;

said adjusting lever and said adjusting wheel when fixedly connected by said locking key through a selected aperture determining the point at which the pulley member comes under the influence of a resistance force.

* * * * *